United States Patent [19]

Packham et al.

[11] Patent Number: 4,797,997

[45] Date of Patent: Jan. 17, 1989

[54] DRY SHAVERS

[75] Inventors: Charles C. Packham, Crowthorne; Robert White, Cholsey; Steven Rogers, Hurstpierpoint, all of England

[73] Assignee: The Gillette Company, Boston, Mass.

[21] Appl. No.: 117,176

[22] Filed: Nov. 4, 1987

[30] Foreign Application Priority Data

Nov. 7, 1986 [GB] United Kingdom ..... 8626631

[51] Int. Cl.[4] ..... B26B 19/02

[52] U.S. Cl. ..... 30/43.92; 30/43.1; 30/89

[58] Field of Search ..... 30/43.1, 43.3, 43.91, 30/43.92, 45, 89

[56] References Cited

U.S. PATENT DOCUMENTS

Re. 21,694 1/1941 Rand ..... 30/43.1
2,526,153 10/1950 Page .
3,136,055 6/1964 Kobler et al. ..... 30/43.1
3,973,323 8/1976 Trees ..... 30/43.92

FOREIGN PATENT DOCUMENTS 1460732 1/1977 United Kingdom .

*Primary Examiner*—Frank T. Yost
*Assistant Examiner*—Michael D. Folkerts
*Attorney, Agent, or Firm*—Scott R. Foster

[57] ABSTRACT

In a twin head dry shaver, the shaver heads are carried at the upper end of a four-bar mounting linkage comprising vertical side members 1A, 1B and bell crank links 2, 3 pivotally connected to the side members at points 7, 8 and 9, 11. The links are pivotally connected to the frame by pivot pins 4 and 6 set above and midway between the connections to the side members, thus rendering the heads highly sensitive to cut of balance forces acting on the heads so that they may move vertically, relative to each other to restore the balance.

9 Claims, 7 Drawing Sheets

DRY SHAVERS

This invention relates to dry shavers of the form comprising a pair of parallel elongate shaver heads mounted on a common shaver frame for movement relative thereto, in use of the shaver, in order to make it easier for the user to maintain both heads in contact with the skin surface being shaved.

A dry shaver of this general form was proposed in U.S. Pat. No. 2,526,153, FIGS. 1 to 7 of which illustrate a shaver having a pair of cylindrical heads supported at opposite ends of a simple "see-saw" support linkage. This arrangement imposes undesirable limitations in design and function. For example, it requires the provision of a mounting arrangement beyond the ends of the heads, thus consuming extra space in a critical area of the shaver where space is at a premium and it entails positioning the pivotal axis of the heads in the same plane as their longitudinal axes, which is functionally far from ideal.

In accordance with a feature of the present invention, the heads of a dry shaver of the form first described are carried at the respective upper ends of a pair of generally vertical, parallel side members mounted on the frame for vertical movement relative to each other and relative to the frame, whilst constrained to remain parallel with each other, the side members being coupled together below their upper ends by at least one transverse link whose opposite ends are pivotally connected to the respective side members and which is pinned intermediate its ends to the frame for pivotal movement about an axis parallel with those of the shaver heads.

For convenience of description, it has been assumed that the side members are vertical, with the heads uppermost, relative to the rest of the dry shaver.

Preferably, the pivotal mounting of the for each) link to the frame is set half-way between the side members and above its connection to the respective side members.

With this construction the mounting arrangement is situated below the heads and is easily accommodated within the body of the shaver, so that the need to establish a physical pivot mounting in the vicinity of the heads is obviated.

Because the side members are coupled to the link below its pivotal mounting, the arrangement is very sensitive to horizontal side forces applied to either head, as well as to generally vertical forces.

Furthermore, it is possible to arrange for a notional plane tangent to the skin engaging surfaces of the two heads to pass through or close to an imaginary fixed pivot point at which the plane intersects a vertical plane of symmetry mid-way between the heads. As will be explained more fully below, this renders the heads highly sensitive to changes in facial contours and enables them to respond rapidly and easily to such changes in maintaining substantially equal pressures on both heads.

One form of dry shaver and a modification thereof, both in accordance with the invention, will now be described, by way of example, with reference to the accompanying drawings, in which.

Figure 1:
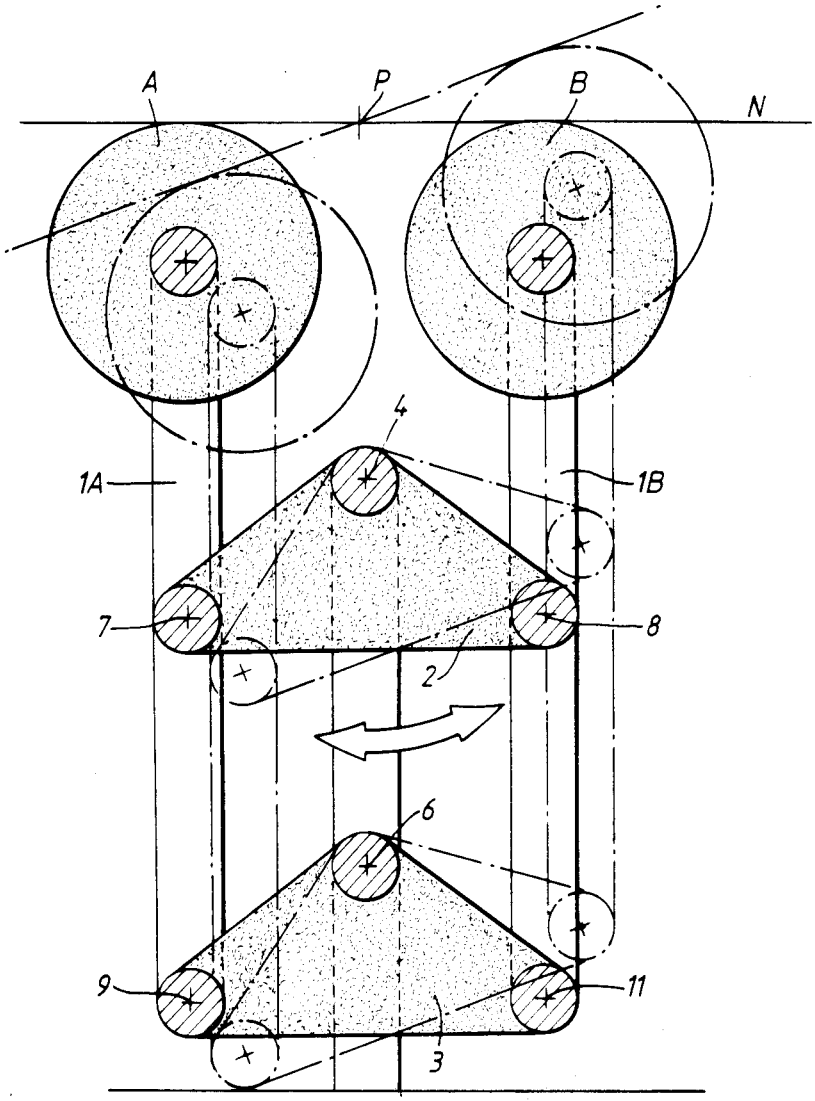
FIG. 1 is a diagrammatic side view of the heads and mounting linkage only.

FIG. 1 illustrates a pair of parallel elongate shaving heads A and B, shown here as cylindrical in cross-section purely in the interests of simplicity. The heads are mounted at the upper ends of vertical side members 1A and 1B of the four bar mounting linkage which is completed by upper and lower transverse link members 2 and 3, formed as identical bell-crank levers pinned at their centres to fixed points 4 and 6 on the shaver frame (not shown). The ends of the upper member 2 are pinned at 7, 8 to the respective side members 1A, 1B, intermediate their ends and the ends of the lower member 3 are pinned at 9, 11 to the lower ends of the respective side members.

In a medial neutral position of the parts a notional tangent N to the upper surfaces of the heads will be horizontal, corresponding to the positions of the heads A, B and of the transverse members 2, 3 shown shaded in the drawing. The application of any force applied to one head which is not exactly counterbalanced by a force applied to the other head will cause the linkage to be displaced angularly about the fixed points 4 and 6. As a result the heads will shadow the pivotal movement of the transverse members 2, 3 and the notional plane N will pivot about an imaginary and fixed pivot point P where the plane intersects the vertical plane of symmetry extending through the fixed pivot points 4 and 6, i.e. mid-way between the heads.

Because the connections 7, 8 and 9, 11 are set at a substantial distance below the fixed pivot points 4 and 6, the linkage is highly sensitive to and readily displaceable by any out-of-balance forces acting on the heads over a wide angular range, from vertically downwards to horizontal.

Furthermore, as the shaver is moved across the skin in use, substantial drag forces are experienced by the heads, essentially acting in the tangent plane, generally perpendicular to the lengths of the heads, and since the imaginary or effective axis P is in this plane at all times, the drag forces do not exert an out of balance couple tending to tilt the heads. This is in contrast to the arrangement shown in U.S. Pat. No. 2,526,153, where the drag forces act at a substantial distance above the pivotal axis and therefore tend to tilt the leading head upwardly, forcing the trailing head down, all of which largely defeats the object of providing for relative movement of the heads, namely to maintain substantially equal pressures on the two heads.

Figure 2:
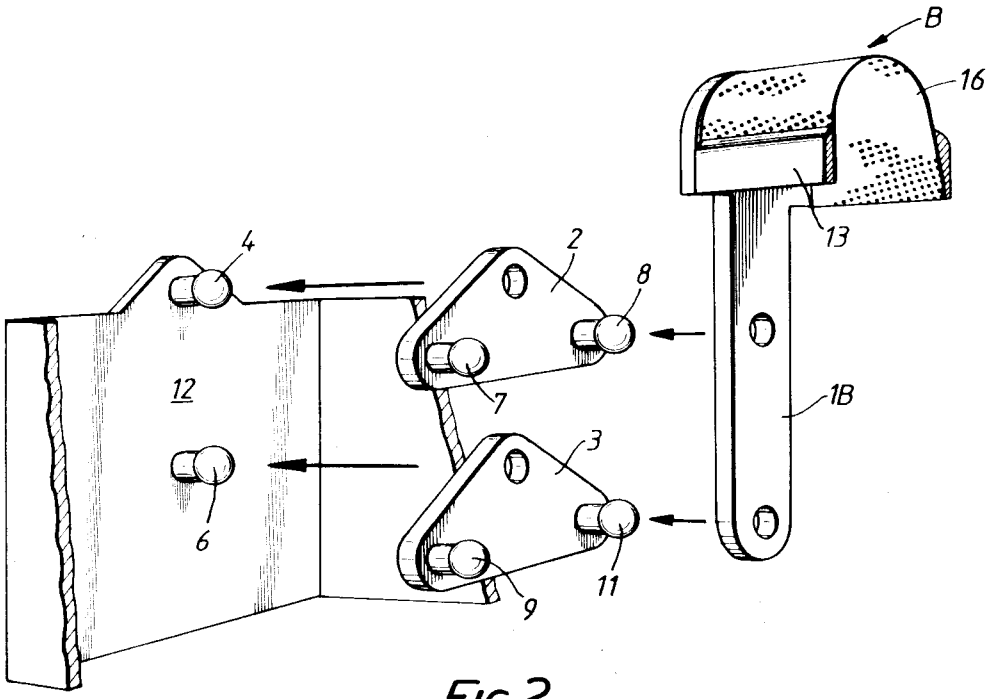
FIG. 2 is an exploded perspective view of part of the dry shaver.

FIG. 2 illustrates the mounting linkage at one end of the shaver frame, whose adjacent end wall 12 carries two fixed pivot pins 4, 6 to mount the members 2, 3, whose respective pins 8, 11 carry the side member 1B. The opposite side member 1A is omitted from the Figure but is received on pins 7, 9. The upper end of side member 1B forms an end wall fast with respective frame members 13, 14 to which an outer, flexible foil 16 of arched form is attached. This mounting linkage is, of course, duplicated at the opposite end of the shaver frame.

Figure 3:
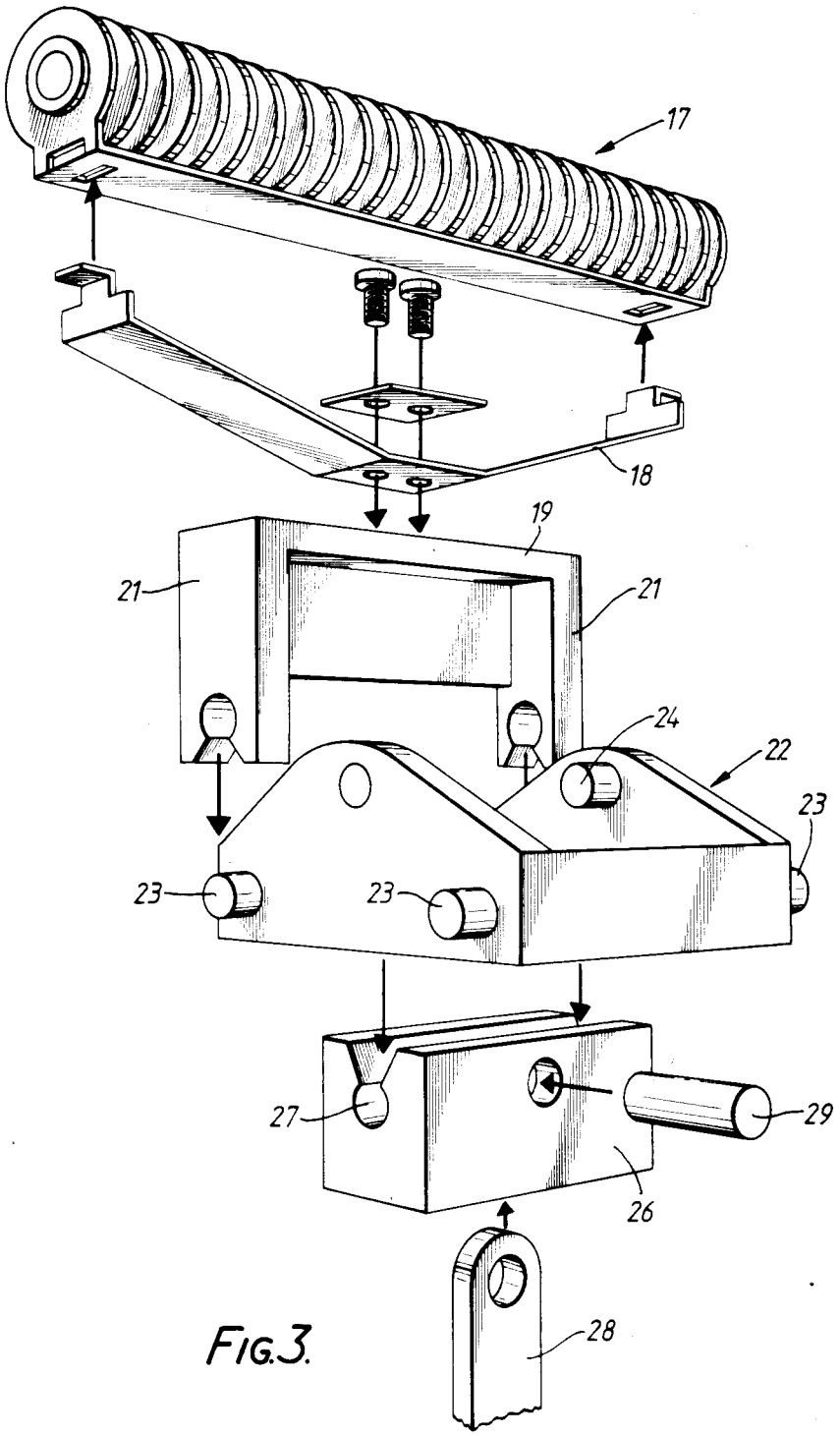
FIG. 3 is an exploded view showing the drive mechanism of the dry shaver.

The inner cutters of the heads are both of identical cylindrical form as indicated at 17 in FIG. 3, which shows the essential features of the drive mechanism for reciprocating the inner cutter.

Each inner cutter 17 is carried by a double cantilever spring 18 secured at its centre to a yoke 19 having depending legs 21 pivotally connected to opposite end walls of a common drive frame 22 on pins 23 projecting outwardly from both ends of the frame and defining first axes. Internally, the frame is provided with aligned central pins 24 defining a second axis, whose geometrical and spatial relationship to the first axes (pins 23) is the same as that of the pins 4 and 6 to the pins 7, 8 and 9, 11, respectively.

A drive block 26 has a longitudinal arcuate recess 27 to receive the pins 24 and is itself coupled to a horizontally reciprocating drive arm 28 by a pin 29.

Thus, the drive frame 22 is pivotable about the axis of central pins 24 and the yokes 19 are pivotable about the axes of the respective pairs of pins 23, enabling the inner cutters 17 to follow exactly the movements of the outer foils relative to the shaver frame. In the assembled shaver the inner cutters are pressed firmly into engagement with their respective outer foils by the springs 18, the upper, operative portions of the foils thus adopting an arcuate form.

Figure 4:
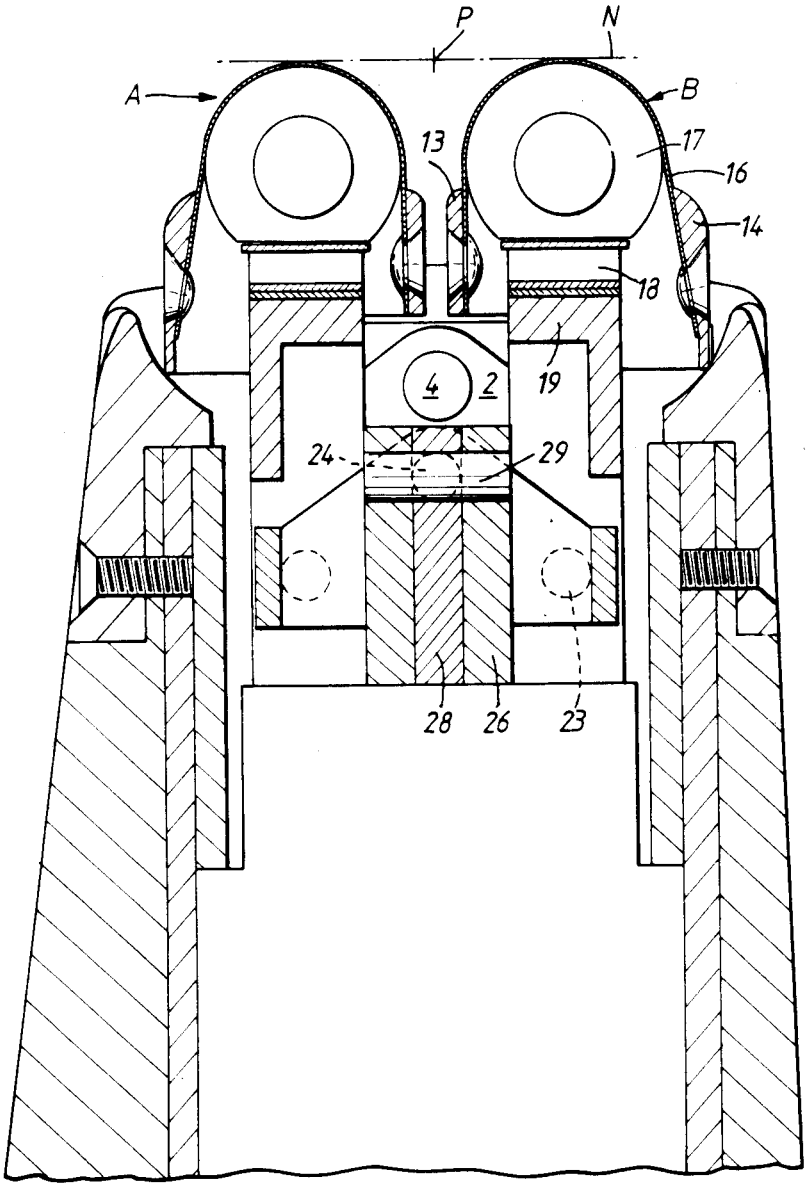
FIGS. 4 and 5 are transverse and longitudinal cross-sections of the upper region of the shaver.
Figure 5:
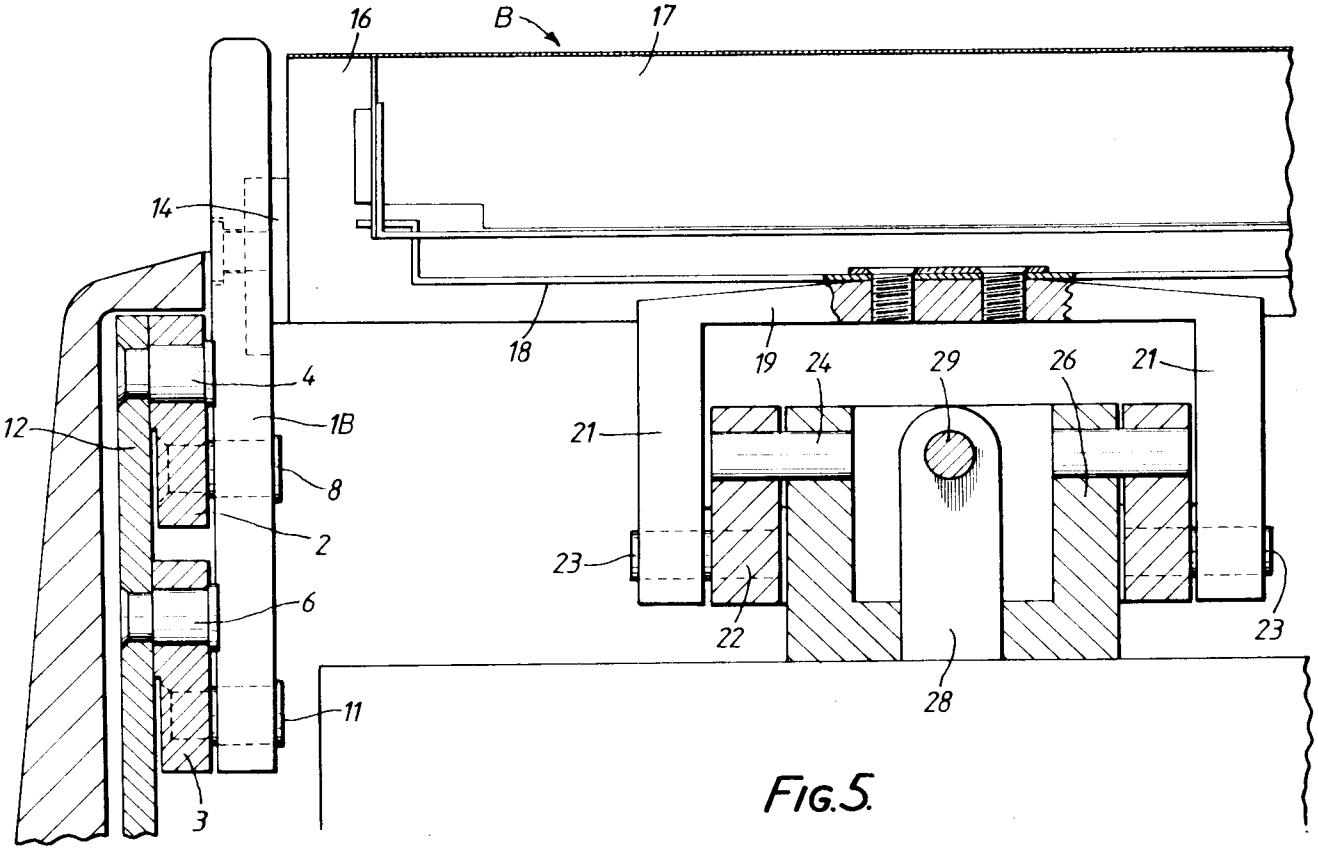

Principal features of the assembly are illustrated in FIGS. 4 and 5 which are transverse and longitudinal cross-sections of the upper region of the dry shaver. The same reference numerals as before are used in these Figures which are not believed to require further explanation.

In one possible modification (not shown) a single transverse link is provided, say intermediate the ends of the side members, the lower ends of which are provided with pins guided in arcuate slots formed in a frame member so as to constrain the side members to maintain their parallel relationship.

Figure 6:
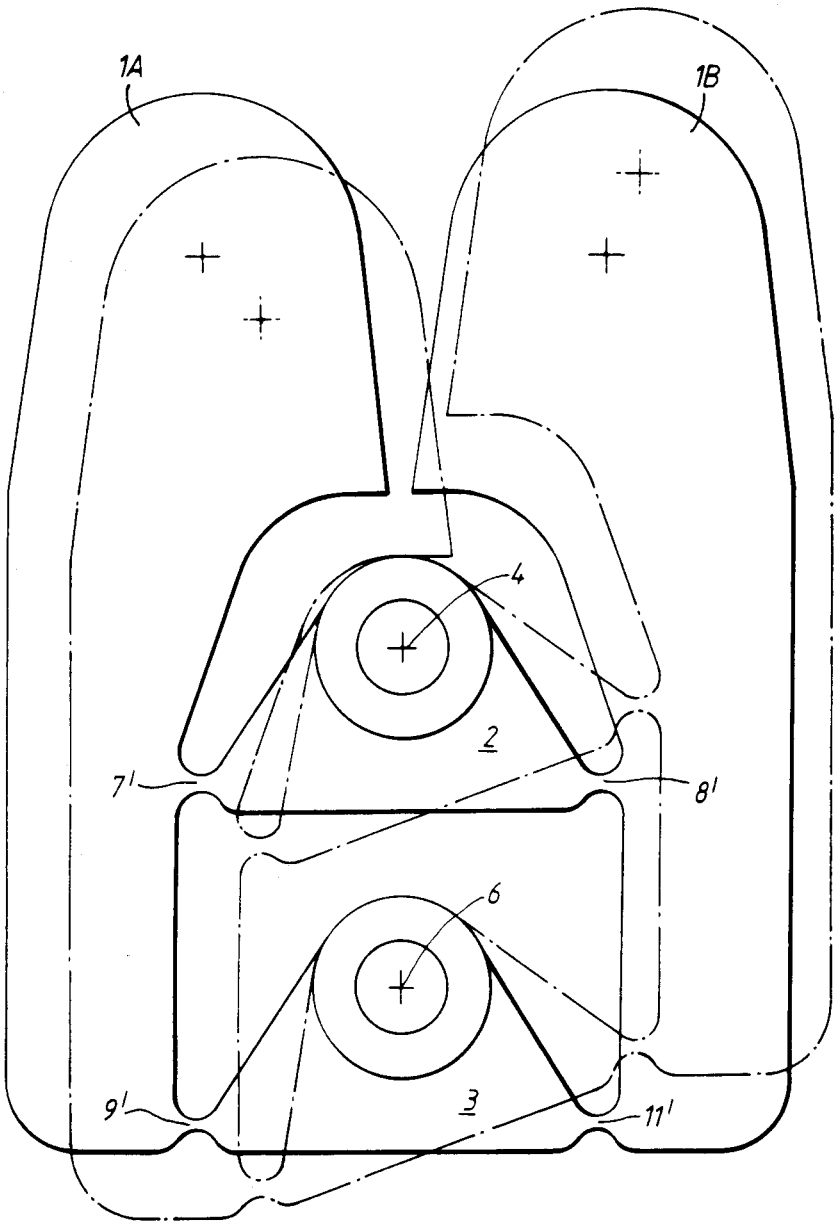
FIG. 6 is a side view showing a modified form of mounting linkage.
Figure 7:
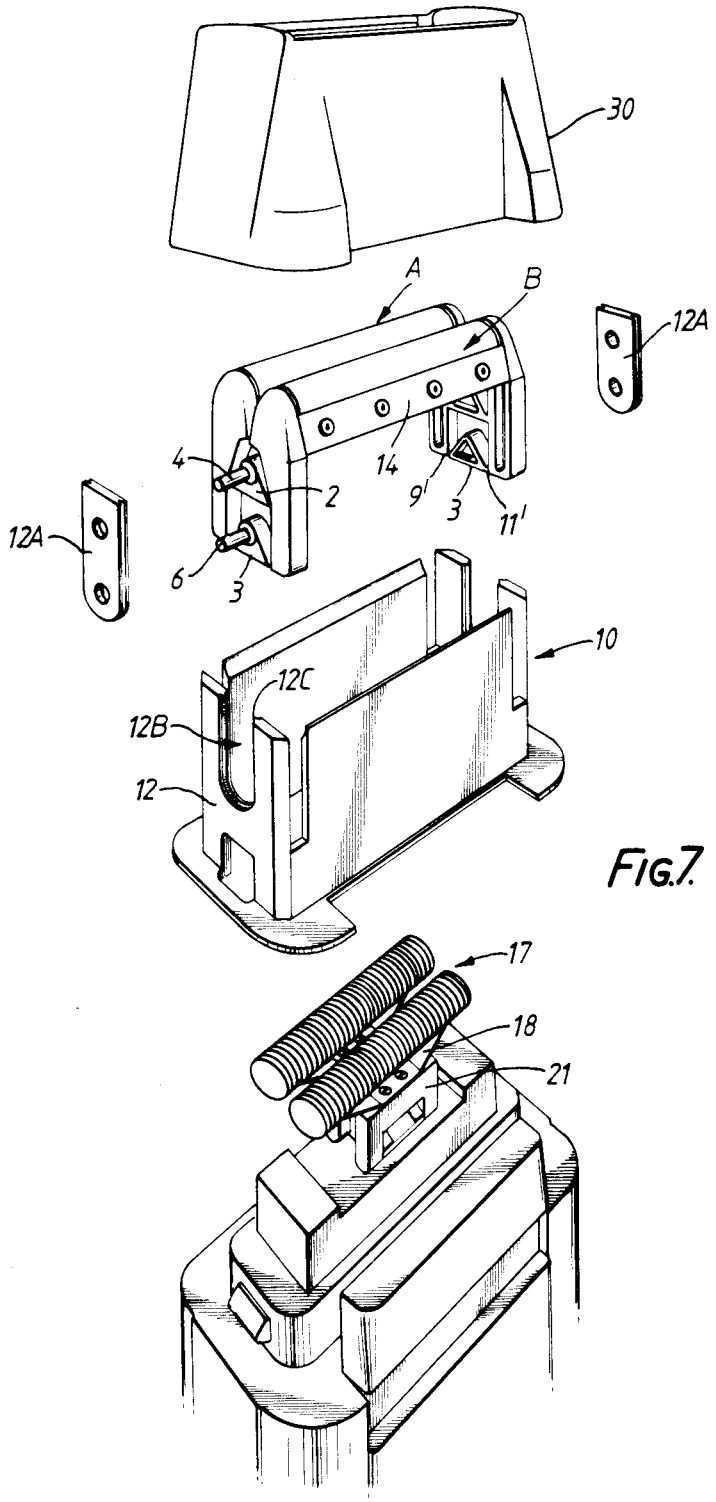
FIG. 7 is an exploded perspective view of a dry shaver incorporating the mounting linkage of FIG. 6.

In the modified dry shaver shown in FIGS. 6 and 7, the general function and operation is as described above in relation to FIGS. 1 to 5, but the constructional details of the mounting arrangement at each end of the heads are modified in that the arms 1A, 1B, link members 2, 3 and pivot pins 4, 6 are all provided in a unitary plastics moulding, the links being integrally connected to the arms by flexible hinges 7', 8', 9' and 11' which perform the functions of the pins 7, 8, 9 and 11 of the first embodiment.

The mouldings are pivotally secured by the pins 4, 6 to apertured mounting plates 12A in turn removably mounted in elongate slots 12B formed in the end walls 12 of a shaver frame shell 10.

The edge of each plate 12A is grooved and the corresponding edge of each slot 12B is formed with a complementary rib 12C to ensure tight engagement of the plate in the slot.

The head assembly is completed by a cover shell 30.

Assembly and demounting of the heads and mounting arrangement as a unit is readily effected, with the cover shell 10 removed, by sliding the plates 12A into and out of the slots 12B.

We claim:

1. A dry shaver comprising a shaver frame, a pair of generally vertical, parallel side members mounted on said frame for vertical movement relative to each other and relative to said frame whilst constrained to remain parallel with each other, said side members being coupled together below their upper ends by at least one transverse link whose opposite ends are pivotally connected to the respective side member and which is pinned intermediate its ends to said frame for pivotal movement about an axis, and a pair of parallel, elongate shaver heads mounted on the respective upper ends of said side members, for movement relative to said shaver frame, each said shaver head comprising an outer foil and a reciprocating inner cutter mounted independently on said frame.

2. A dry shaver according to claim 1, wherein the pivotal axis of said link is half-way between and above its connections to the respective side members.

3. A dry shaver according to claim 2, wherein the said heads have arcuate, skin engaging outer surfaces, and a notional plane tangent to those surfaces intersects a vertical plane of symmetry which is mid-way between the heads at the same point, in all relative positions of the heads.

4. A dry shaver according to claim 1, wherein said dry shaver includes two pairs of said side members, each said pair of side members having an associated transverse link, and one pair of the said side members and its associated link are provided at each end of the shaver heads.

5. A dry shaver according to claim 1, wherein each shaver head comprises an outer foil mounted to the shaver frame in the manner specified and a pair of reciprocating inner cutters are mounted independently on the frame by a drive mechanisms constructed and arranged to permit the inner cutters to follow the relative movements of the outer foils.

6. A dry shaver according to claim 1, wherein said dry shaver includes two pairs of said side members, each said pair of side members having a single link between each pair of side members intermediate the ends thereof and means for guiding the lower ends of the side members to move in arcuate paths so that said side members are constrained to remain parallel with each other.

7. A dry shaver according to claim 1, wherein said dry shaver includes two pairs of said side members, each said pair of side members having an associated transverse link, and each pair of side members and its associated link are mounted on a removable portion of the shaver frame, to enable the said members and links, together with the shaver heads carried thereby to be detached as a unit from the shaver.

8. A dry shaver comprising a shaver frame, a pair of generally vertical, parallel side members mounted on said frame for vertical movement relative to each other and relative to said frame whilst constrained to remain parallel with each other, said side members being coupled together below their upper ends by at least one transverse link whose opposite ends are pivotally connected to the respective side members and which is pinned intermediate its ends to said frame for pivotal movement about an axis, and a pair of parallel, elongate shaver heads mounted on the respective upper ends of said side members for movement relative to said shaver frame, each said shaver head comprising an outer foil and a reciprocating inner cutter mounted imdependently on said frame, cutter drive mechanism coupled to said inner cutters and arranged to permit said inner cutters to follow the relative movements of said outer foils, said inner cutters being resiliently mounted on yokes having depending leg members connected for pivotal movement, about respective first axes, relative to a common mounting member which is in turn connected for pivotal movement about a second axis relative to said drive mechanism, the said first and second axes having the same geometrical and spatial relationship with each other as the pivotal connections between each link, said side members and said shaver frame.

9. A dry shaver comprising a shaver frame, two pair of generally vertical, parallel side members mounted on said frame for vertical movement relative to each other and relative to said frame whilst constrained to remain parallel with each other, each said pair of side members being coupled together below their upper ends by at least one transverse link whose opposite ends are pivotally connected to the respective side members and which is pinned intermediate its ends to said frame for pivotal movement about an axis, and a pair of parallel, elongate shaver heads mounted on the respective upper ends of said side members for movement relative to said shaver frame, each said pair of side members and its associated link being formed in a unitary plastics moulding, each link being integrally connected to the respective side members by flexible hinges.

* * * * *